US007166994B2

(12) United States Patent
Lee et al.

(10) Patent No.: US 7,166,994 B2
(45) Date of Patent: Jan. 23, 2007

(54) BANDGAP REFERENCE CIRCUITS

(75) Inventors: Chao-Chi Lee, Taipei (TW); Wen-Cheng Yen, Hsinchu (TW)

(73) Assignee: Faraday Technology Corp., Hsin-Chu (TW)

( * ) Notice: Subject to any disclaimer, the term of this patent is extended or adjusted under 35 U.S.C. 154(b) by 73 days.

(21) Appl. No.: 11/018,017

(22) Filed: Dec. 21, 2004

(65) Prior Publication Data

US 2005/0237045 A1 Oct. 27, 2005

(30) Foreign Application Priority Data

Apr. 23, 2004 (TW) ..... 93111396 A

(51) Int. Cl.
*G05F 3/16* (2006.01)

(52) U.S. Cl. ..... 323/313; 323/273; 323/907; 327/543

(58) Field of Classification Search ..... 323/312–316, 323/280, 273, 901; 327/538–541, 546, 513
See application file for complete search history.

(56) References Cited

U.S. PATENT DOCUMENTS 5,666,046 A * 9/1997 Mietus ..... 323/313
5,933,051 A * 8/1999 Tsuchida et al. ..... 327/543
6,060,870 A * 5/2000 Seevinck ..... 323/273
6,111,396 A * 8/2000 Lin et al. ..... 323/313

* cited by examiner

*Primary Examiner*—Rajnikant B. Patel
(74) *Attorney, Agent, or Firm*—Winston Hsu

(57) ABSTRACT

A bandgap reference circuit. In the bandgap reference circuit, a current generator includes a first bipolar junction transistor (BJT) and generates a first positive temperature coefficient current thereby producing a negative temperature coefficient voltage between a base terminal and an emitter terminal of the first bipolar junction transistor. A single-end gain amplifier includes a positive input terminal coupled to the emitter terminal of first the bipolar junction transistor. A first resistor is coupled between the output terminal of the single-end gain amplifier and an output terminal of the bandgap reference circuit to generate a first current. A current-to-voltage converter is coupled to the first resistor to convert the first positive temperature coefficient current and the first current to a bandgap voltage.

25 Claims, 10 Drawing Sheets

BANDGAP REFERENCE CIRCUITS

BACKGROUND

The invention relates to bandgap circuits, and more particularly, to bandgap reference circuits capable of generating bandgap voltage without varying temperature and manufacturing variations.

In integrated circuits, while reference generators are required output voltages thereof are typically fixed at 1.23V and are not applicable in low voltage operation.

FIG. 1 shows a conventional reference voltage generator with temperature compensation. As shown, the reference voltage generator includes a PMOS transistor M11, three resistors R10~R13, an operational amplifier OP11, bipolar junction transistor (BJT) Q12, and eight parallel connected BJTs Q11. The voltage $V_{BE1}$ is generated between the emitter terminals and the base terminals of the BJTs Q11, and a current $I_{C1}$ (not shown) flows through each BJT Q11. The voltage $V_{BE2}$ is generated between the emitter terminals and the base terminals of the BJTs Q12, and the current $I_{C2}$ flows through the BJT Q12. The PMOS transistor M11 includes a source terminal coupled to an operating voltage VCC, a gate terminal coupled to an output terminal of the amplifier OP11, and a drain terminal coupled to the resistor R13. The resistor R10 has a first end coupled to the resistor R11 and the positive input terminal of the operational amplifier OP11, and the other end coupled to the emitter terminals of the parallel connected BJTs Q11. The resistor R12 includes one end coupled to the resistors R11 and R13 and the other end coupled to the negative input terminal of the amplifier and the emitter terminal of the BJT Q12.

The operational amplifier OP11 includes a positive input terminal coupled to the connection (node A) between the resistors R10 and R11, and a negative input terminal coupled to the connection (node B) between the resistor R12 and the emitter terminal of the BJT Q12. The operational amplifier OP11 normalizes the voltages on the nodes A and B, and generates a bandgap voltage $V_{BG}$ at the connection between the resistor R13 and the drain terminal of the PMOS transistor M11.

$$V_{BG} = V_{BE2} + \frac{V_T \ln\left(\frac{I_{C2}}{I_{C1}}\right)}{R_{10}}\left[\frac{R_{11}}{R_{12}} \times R_{12} + \left(1 + \frac{R_{11}}{R_{12}}\right)R_{13}\right],$$

wherein $V_T = \frac{KT}{q}$, and the parameter $V_T$ is a positive temperature coefficient. Thus, the voltage across the resistors R12 and R13 has a positive temperature coefficient, and the voltage $V_{BE2}$ a negative temperature coefficient. Consequently, a stable voltage $V_{BG}$ unaffected by temperature and manufacturing variations is obtained.

The reference voltage $V_{BG}$ with temperature compensation, however, is limited to 1.23V because the negative temperature coefficient is a constant. Thus, this conventional reference circuit cannot provide required reference voltage for low voltage operation.

SUMMARY

Embodiments of the invention provide a bandgap reference circuit, in which a current generator includes a first bipolar junction transistor (BJT) and generates a first positive temperature coefficient current thereby producing a negative temperature coefficient voltage between a base terminal and an emitter terminal of the first bipolar junction transistor. A single-end gain amplifier includes a positive input terminal coupled to the emitter terminal of first the bipolar junction transistor and an output terminal. A first resistor is coupled between the output terminal of the single-end gain amplifier and an output terminal of the bandgap reference circuit to generate a first current. A current-to-voltage converter is coupled to the first resistor to convert the first positive temperature coefficient current and the first current to a bandgap voltage.

Also provided is another bandgap reference circuit. In the bandgap reference circuit, a current generator has first bipolar junction transistors (BJTs) connected in parallel and generates a first positive temperature coefficient current, thereby producing a negative temperature coefficient voltage between base terminals and emitter terminals of the first bipolar junction transistors. A single-end gain amplifier includes a positive input terminal coupled to the emitter terminals of the first bipolar junction transistors and an output terminal. A first resistor is coupled between the output terminal of the single-end gain amplifier and an output terminal of the bandgap reference circuit to generate a first current. A current-to-voltage converter is coupled to the first resistor to convert the first positive temperature coefficient current and the first current to a bandgap voltage.

Also provided is another bandgap reference circuit. In the bandgap reference circuit, a current generator includes a first bipolar junction transistor (BJT) to generate a first positive temperature coefficient current and a plurality of second bipolar junction transistors connected in parallel to generate a second positive temperature coefficient current. A first resistor is coupled between an emitter terminal of the first bipolar junction transistor and an output terminal of the bandgap reference circuit to generate a first current. A second resistor is coupled between the output terminal of the bandgap reference circuit and emitter terminals of the second bipolar junction transistors to generate a second current. A current-to-voltage converter is coupled to the first and second resistors to convert the first and second positive temperature coefficient currents and the first and second currents to a bandgap voltage.

BRIEF DESCRIPTION OF THE DRAWINGS

Embodiments of the invention can be more fully understood by the subsequent detailed description and examples with reference made to the accompanying drawings, wherein.

DETAILED DESCRIPTION

Figure 1:
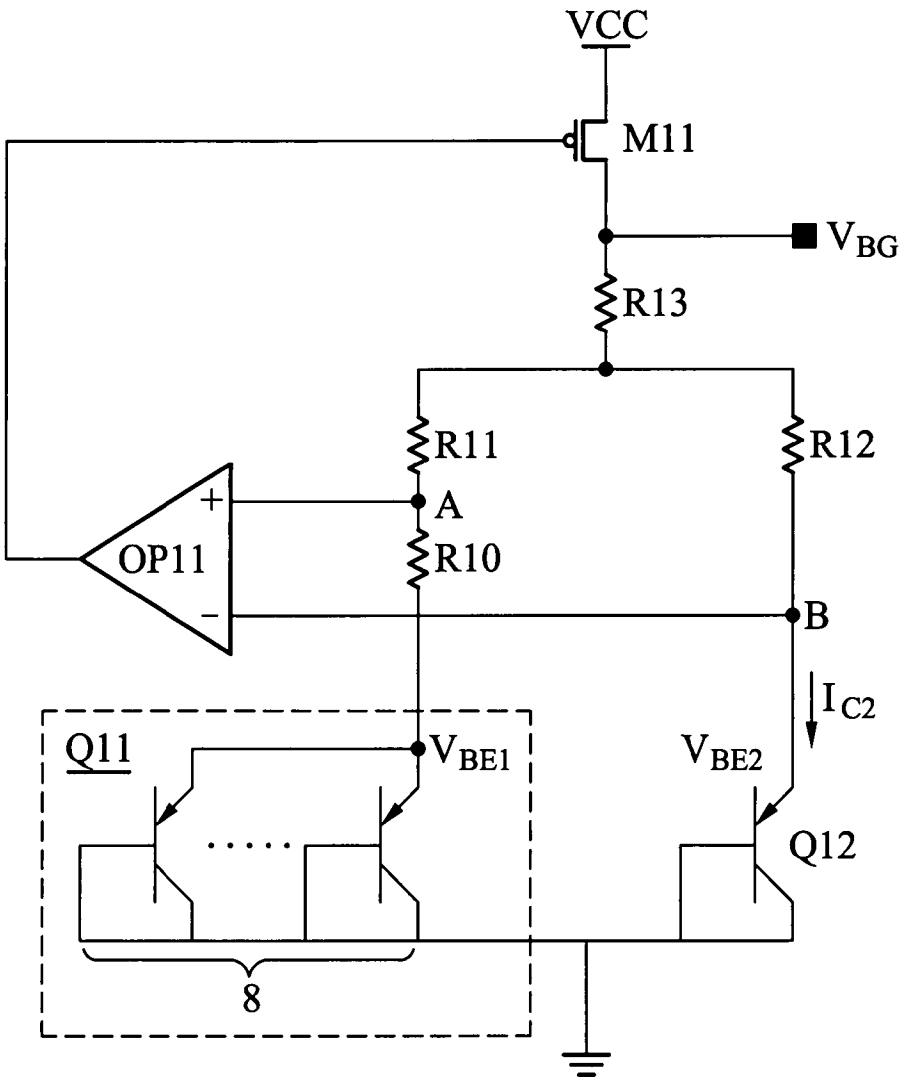
FIG. 1 shows a conventional reference voltage generator with temperature compensation.
Figure 2:
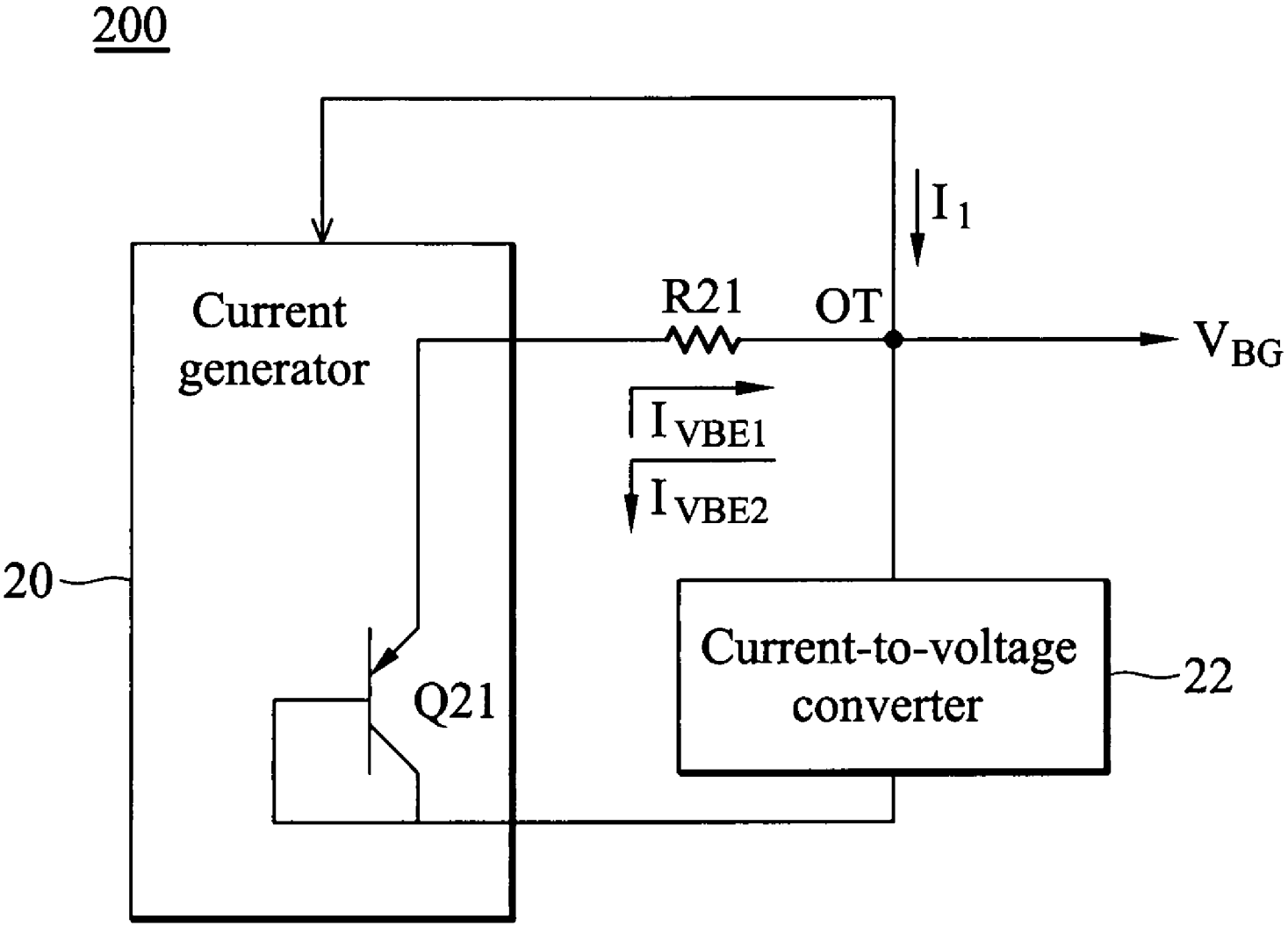
FIG. 2 shows a bandgap reference circuit of embodiments of the invention.

FIG. 2 shows a bandgap reference circuit of embodiments of the invention. A current generator 20 includes bipolar junction transistor (BJT) Q21, and generates a positive temperature coefficient current $I_1$ between the emitter terminal and base terminal of the BJT Q21. A resistor R21 is coupled between the emitter terminal of the BJT Q21 and the output terminal (node) OT of the bandgap reference circuit 200 to generate a negative temperature coefficient current $I_{VBE1}$ or a positive temperature coefficient current $I_{VBE2}$. A current-to-voltage converter 22 converts the positive temperature coefficient current $I_1$ and the negative temperature coefficient current $I_{VBE1}$ or a positive temperature coefficient current $I_{VBE2}$ to a bandgap voltage $V_{BG}$.

It should be noted that the resistor R21 generates the negative temperature coefficient current $I_{VBE1}$ when the bandgap voltage is less than that between the emitter terminal and base terminal of the BJT Q21. Conversely, the resistor R21 generates the positive temperature coefficient current $I_{VBE2}$ when the bandgap voltage exceeds the voltage between the emitter terminal and base terminal of the BJT Q21.

First Embodiment

Figure 3A:
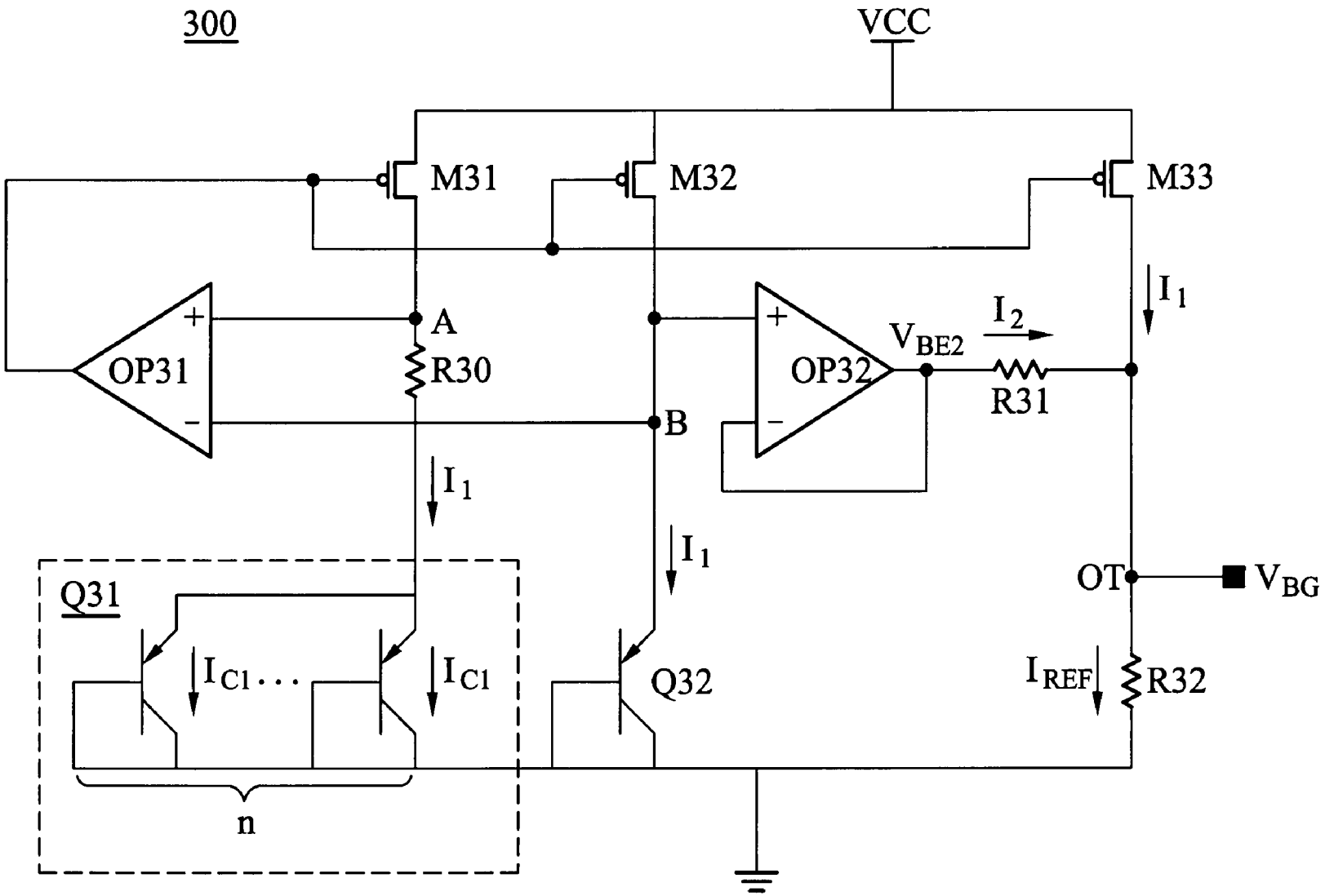
FIGS. 3*a* and 3*b* show a bandgap reference circuit of a first embodiment of the invention.
Figure 3B:
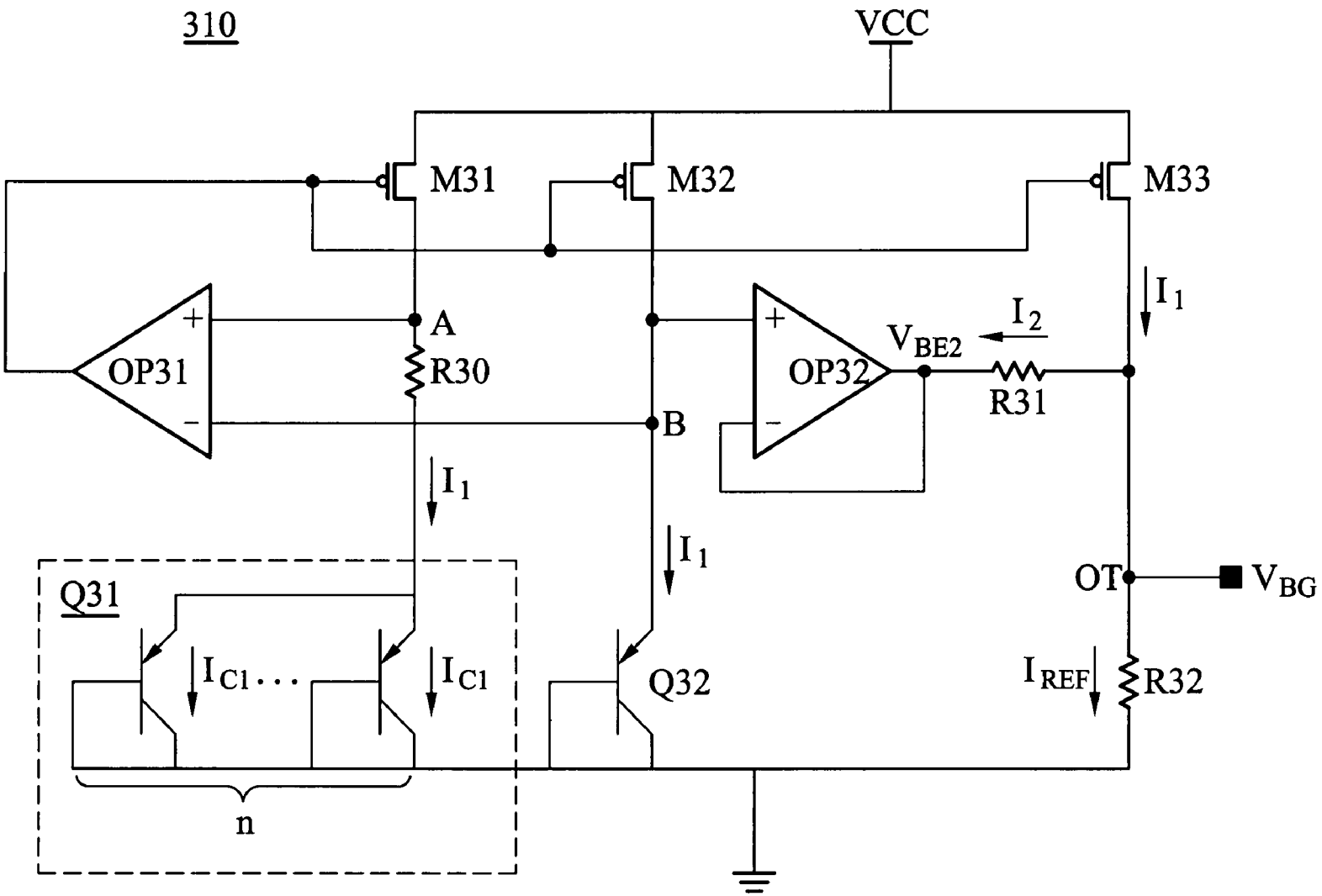

FIGS. 3*a* and 3*b* show a bandgap reference circuit of a first embodiment of the invention. As shown in FIG. 3*a*, the bandgap reference circuit 300 includes three PMOS transistors M31~M33, three resistors R30~R32, an operational amplifier OP31, a single-end gain amplifier OP32, a BJT Q32 and parallel connected BJTs Q31.

The PMOS transistors M31~M33, resistor R30, an operational amplifier OP31, a single-end gain amplifier OP32, BJT Q32 and parallel connected BJTs Q31 constitute a current generator to generate the positive temperature coefficient current $I_1$. The base terminals and the Collector terminals of the BJTs Q31 are coupled to a ground voltage, with the voltage $V_{BE1}$ (not shown) between the base terminal and emitter terminals, and the current $I_{C1}$ through each BJT Q31. Further, the base terminal and Collector terminal of the BJTs Q32 are coupled to the ground voltage, with the voltage $V_{BE2}$ between the base terminal and emitter terminal, and the current $I_1$ through the BJT Q32, wherein the voltage $V_{BE2}$ is a negative temperature coefficient voltage.

The source terminals of PMOS transistors M31~M33 are coupled to an operating voltage VCC, gate terminals of which are coupled to the output terminal of the operational amplifier OP31. The resistor R30 includes an end coupled to the emitter terminals of the BJTs Q31 and the other end coupled to the drain terminal of the PMOS transistor M31 and the positive input terminal of the operational amplifier OP31. The drain terminal of the PMOS transistor M32 is coupled to the negative input terminal of the operational amplifier OP31, the emitter terminal of the BJT Q32 and the positive input terminal of the single-end gain amplifier OP32.

The single-end gain amplifier OP32 includes a negative input terminal coupled to an output terminal thereof. The voltage at the output terminal of the amplifier OP32 is also $V_{BE2}$ because the positive input terminal, the negative input terminal and the output terminal of the single-end gain amplifier OP32 have the same voltage level.

The resistor R31 is coupled between the output terminal of the single-end gain amplifier OP32 and the output terminal OT of the bandgap reference circuit, the current through the resistor R31 is $I_2$. As shown in FIG. 3*a*, the bandgap voltage is less than the voltage between the base terminal and the emitter terminal of the BJT Q32, and thus, the current $I_2$ through the resistor R31 is a negative temperature coefficient current.

Because there is no current between the positive and negative input terminals, the current $I_1$ through the BJT Q32 exceeds the current $I_{C1}$ through each BJT Q31 of the parallel BJTs such that the voltage across the resistor R30 is a positive temperature coefficient voltage, if the size of the PMOS transistors M31~M33 is adequate. In the example shown in FIG. 3*a*, the PMOS transistors M31~M33 have the same size such that the current through the BJT Q32 and the total current through parallel connected BJTs Q31 are both $I_1$. Thus, the resistor R32 combines the positive temperature coefficient current $I_1$ with the negative temperature coefficient current $I_2$ to a current $I_{REF}$, and converts to a bandgap voltage $V_{BG}$ unaffected by temperature and manufacturing variations.

$$V_{BG} = (I_1 + I_2) \times R32 = \left[\left(\frac{V_T \ln \frac{I_1}{I_{C1}}}{R30}\right) + \left(\frac{V_{BE2} - V_{BG}}{R31}\right)\right] \times R32$$

$$\therefore V_{BG} = \left(\frac{R31 \times R32}{R31 + R32}\right)\left[\left(\frac{V_T \ln \frac{I_1}{I_{C1}}}{R30}\right) + \left(\frac{V_{BE2}}{R31}\right)\right]$$

As shown in FIG. 3*b*, the bandgap reference circuit 310 is similar to the circuit 300 in FIG. 3*a* except that, in circuit 310, the generated bandgap voltage $V_{BG}$ exceeds the voltage between the base terminal and the emitter of the BJT Q32. Thus, the current $I_2$ through the resistor R31 is a positive temperature coefficient current. The resistor R32 combines the positive temperature coefficient current $I_1$ with the positive temperature coefficient current $I_2$ to a current $I_{REF}$, and converts to a bandgap voltage $V_{BG}$ unaffected by temperature and manufacturing variations.

Second Embodiment

Figure 4A:
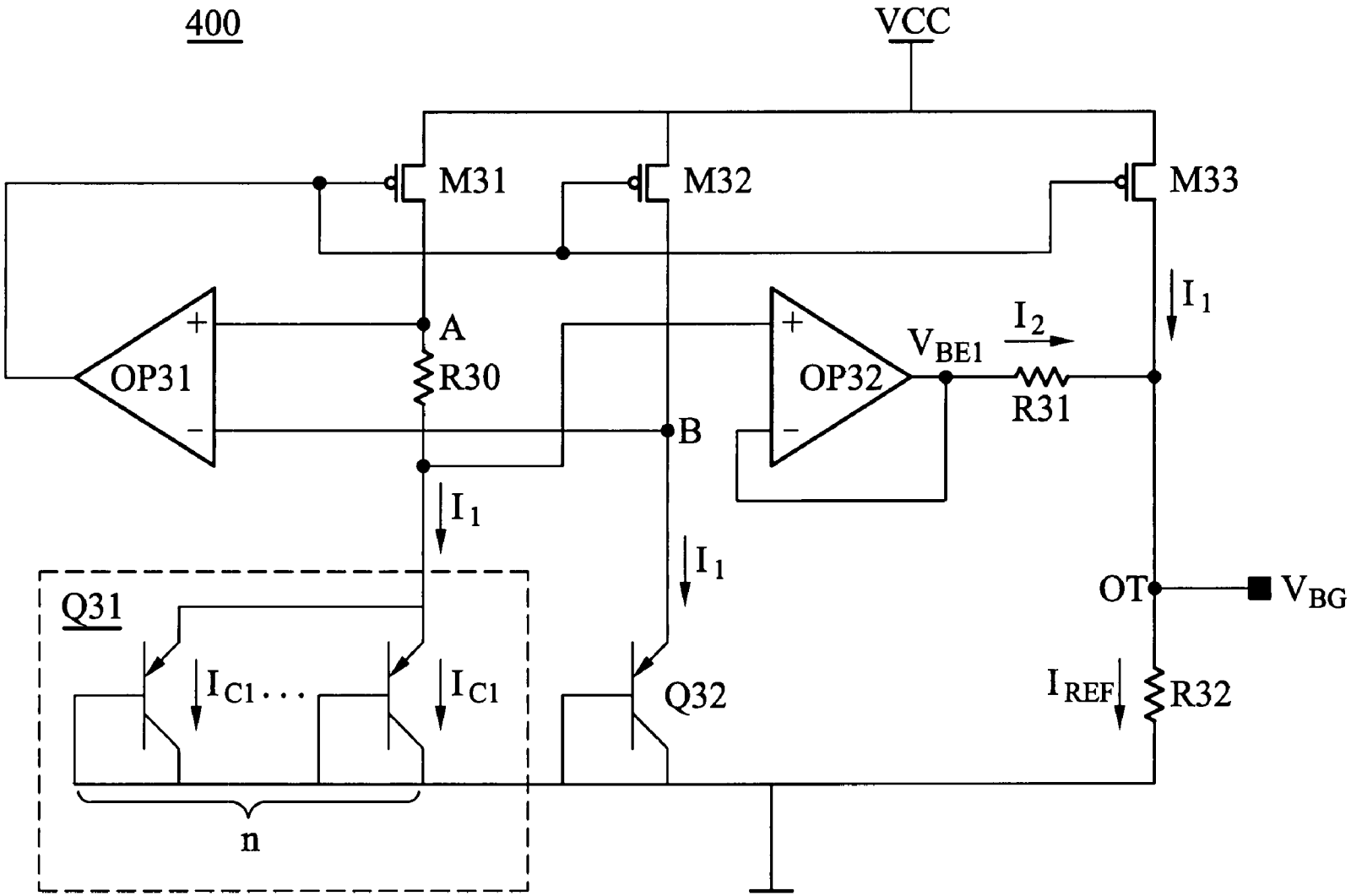
FIGS. 4*a* and 4*b* show a bandgap reference circuit of a second embodiment of the invention.
Figure 4B:
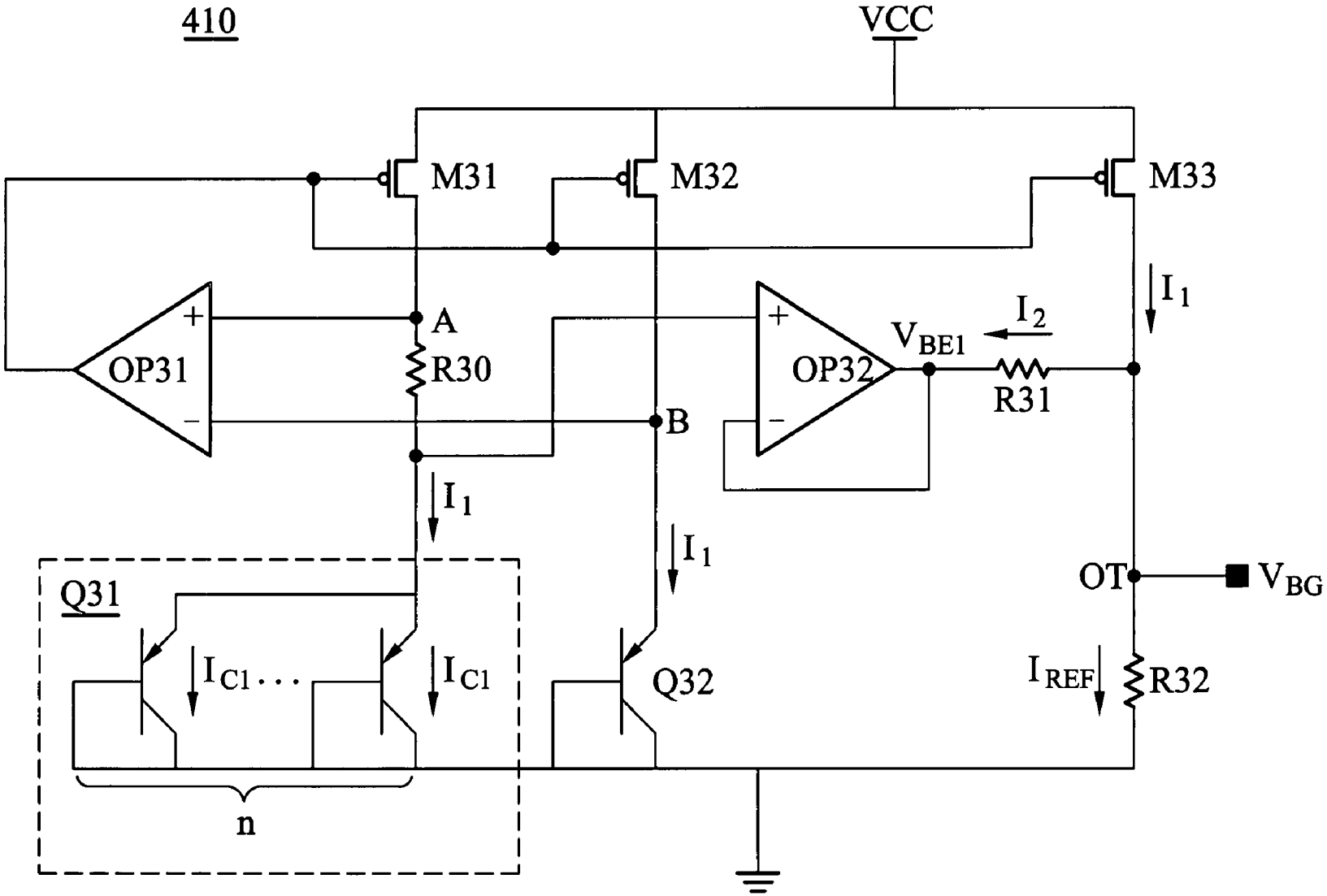

FIGS. 4*a* and 4*b* show a bandgap reference circuit of a second embodiment of the invention. As shown, the bandgap reference circuit 400 is similar to the circuit 300 shown in FIG. 3*a* except that the positive input terminal of the single-end amplifier 32 is coupled to resistor R30 and the emitter terminals of the parallel connected BJTs Q31 rather than the drain terminal of the PMOS transistor, the emitter terminal of the BJT Q32 and the negative input terminal of the operational amplifier OP31. The resistor R31 is coupled between the output terminal of the single-end gain amplifier OP32 and the output terminal OT of the bandgap reference circuit, the current through the resistor R31 is $I_2$. As shown in FIG. 4*a*, the bandgap voltage is less than the voltage between the base terminal and the emitter terminal of the BJT Q32, and thus, the current $I_2$ through the resistor R31 is a negative temperature coefficient current.

As shown in FIG. 4*b*, the bandgap reference circuit 410 is similar to the circuit 310 shown in FIG. 3*a* except that the positive input terminal of the single-end amplifier 32 is coupled to resistor R30 and the emitter terminals of the parallel connected BJTs Q31 rather than the drain terminal of the PMOS transistor, the emitter terminal of the BJT Q32 and the negative input terminal of the operational amplifier OP31. Further, in the circuit 410, the generated bandgap voltage $V_{BG}$ exceeds the voltage between the base terminal and the emitter of the BJT Q32. Thus, the current $I_2$ through the resistor R31 is a positive temperature coefficient current. The resistor R32 combines the positive temperature coefficient current $I_1$ with the positive temperature coefficient current $I_2$ to a current $I_{REF}$, and converts to a bandgap voltage $V_{BG}$ unaffected by temperature and manufacturing variations.

Third Embodiment

Figure 5A:
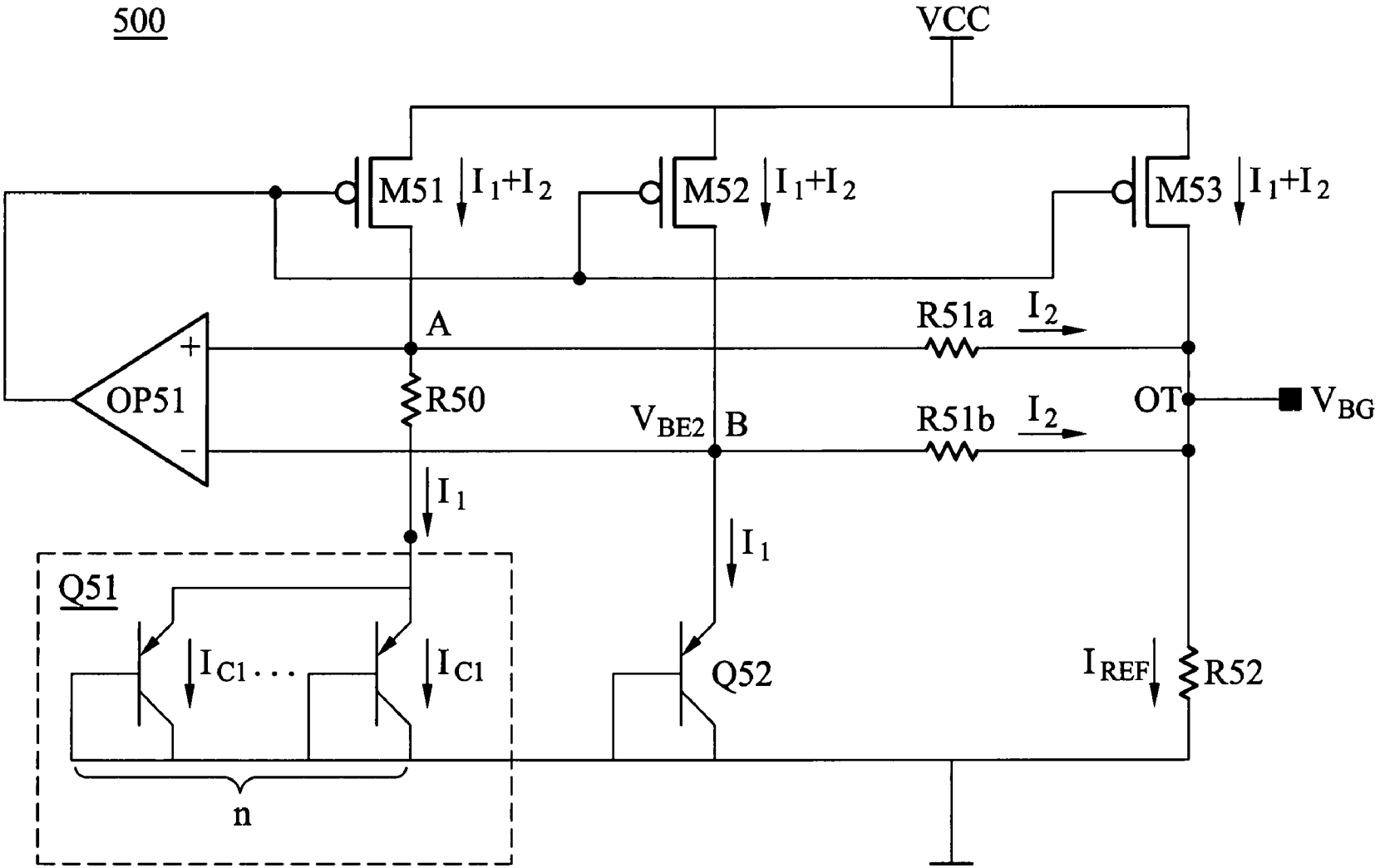
FIGS. 5*a* and 5*b* show a bandgap reference circuit of a third embodiment of the invention.
Figure 5B:
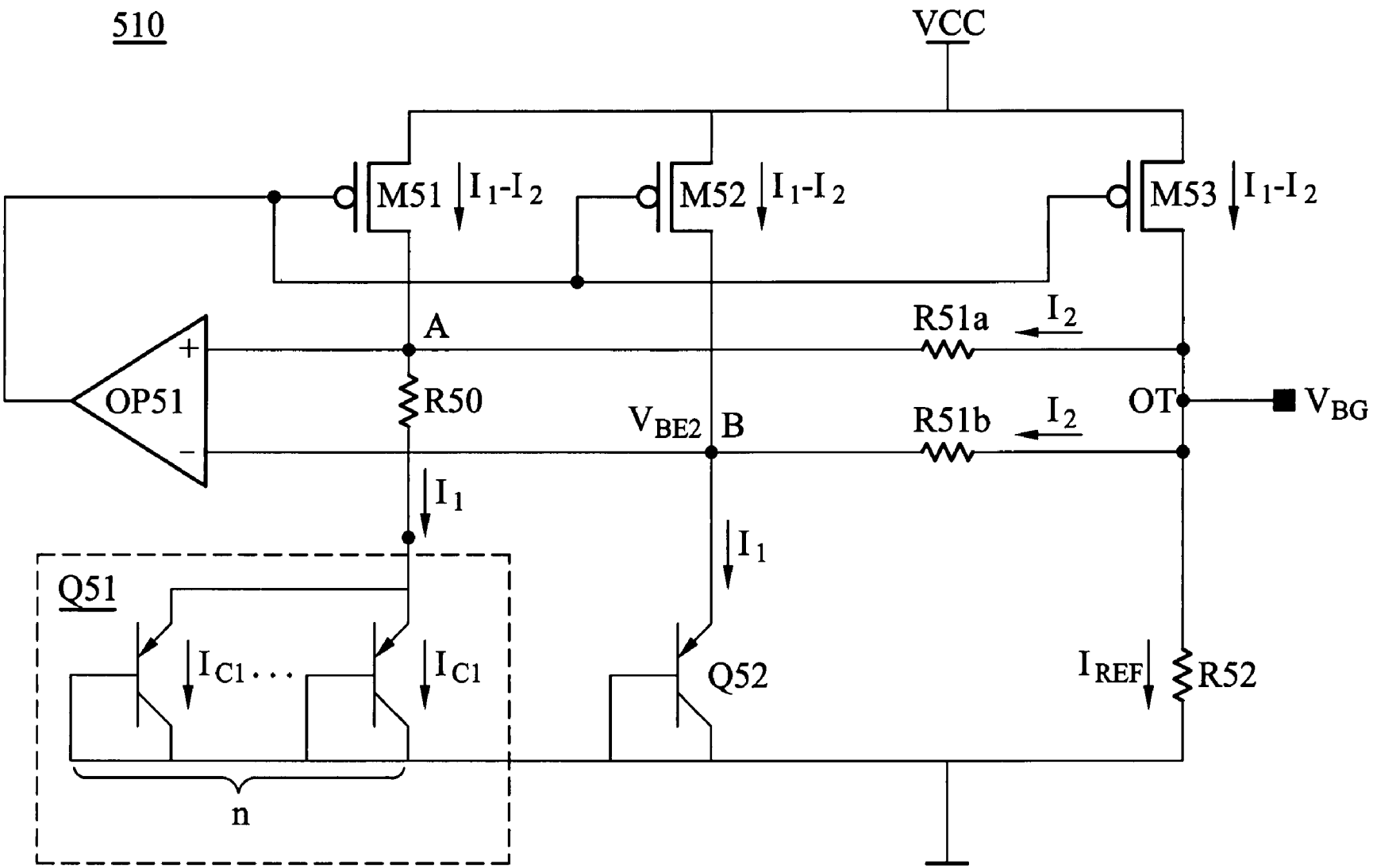

FIGS. 5*a* and 5*b* show a bandgap reference circuit of a third embodiment of the invention. As shown in FIG. 5*a*, the bandgap reference circuit 500 includes PMOS transistors M51~M53, resistors R50, R51*a*, R51*b* and R52, an operational amplifier OP51, a BJT Q52 and parallel connected BJTs Q51.

In FIG. 5*a*, the PMOS transistors M51~M53, the resistor R50, the operational amplifier OP51, the BJT Q52 and the parallel connected BJTs Q51 constitute the current generator to generate the positive temperature coefficient current $I_1$. The resistor R52 serves as a current-to-voltage converter. The parallel connected BJTs have N BJTs Q51, the base terminals and emitter terminals of the parallel connected BJTs Q51 are coupled to the ground voltage. The voltage between the base terminals and emitter terminals of the parallel connected BJTs Q51 is $V_{BE1}$ (not shown), and the current through each BJT Q51 is $I_{C1}$. Further, the base terminal and emitter terminal of the BJT Q52 are both coupled to the ground voltage, with the voltage $V_{BE2}$ between the base terminal and emitter terminal, wherein the voltage $V_{BE2}$ is a negative temperature coefficient voltage, with the current through the BJT Q52 is $I_1$.

The source terminals of the PMOS transistors M51~M53 are coupled to an operating voltage VCC, and gate terminals of which are coupled to the output terminal of the operational amplifier OP51. The drain terminal of the PMOS transistor M51 is coupled to the positive terminal of the operational amplifier OP51 and the resistors R50 and R51*a*. The drain terminal of the PMOS transistor M52 is coupled to the negative terminal of the operational amplifier OP51, the resistor R51*b*, and the emitter terminal of the BJT Q52. The drain terminal of the PMOS transistor M53 is coupled to the resistors R51*a*, R51*b* and R52.

The resistor R51*a* is coupled between the positive input terminal of the operational amplifier OP51 and the output terminal OT of bandgap reference circuit 500, wherein the current through the resistor R51*a* is $I_2$. The resistor R51*b* is coupled between the negative input terminal of the operational amplifier OP51 and the output terminal OT of bandgap reference circuit 500, wherein the current through the resistor R51*a* is also $I_2$, if R51*a*=R51*b*

It should be noted that an optional single-end gain amplifier can also be disposed between node A and the resistor R51*a* or between node B and the resistor R51*b* (not shown).

As shown in FIG. 5*a*, the generated bandgap voltage $V_{BG}$ is less than the voltage between the base terminal and the emitter terminal of the BJT Q52, such that the currents $I_2$ through the resistors R51*a* and R51*b* are negative temperature coefficient currents.

The current $I_1$ through the BJT Q52 exceeds the current $I_{C1}$ through each BJT Q51 of the parallel BJTs such that the voltage across the resistor R50 is a positive temperature coefficient voltage, if the size of the PMOS transistors M51~M53 is designed adequate. For example, the PMOS transistors M51~M53 are the same size and the resistors R51*a* and R51*b* also are the same size, such that the current through the BJT Q52 and the total current of the currents through parallel connected BJTs Q51 are both $I_1$, wherein resistances of R51*a* and R51*b* are both R51. Thus, resistor R52 combines the positive temperature coefficient current $I_1$ with the three negative temperature coefficient currents $I_2$ to a current $I_{REF}$, and converts to a bandgap voltage VBG unaffected by temperature and manufacturing variations.

$$V_{BG} = \left[\left(\frac{V_T \ln \frac{I_1}{I_{C1}}}{R50}\right) + 3 \times \left(\frac{V_{BG} - V_{BE2}}{R51}\right)\right] \times R52$$

$$\therefore V_{BG} = \left(\frac{R51 \times R52}{R51 - 3R52}\right)\left[\left(\frac{V_T \ln \frac{I_1}{I_{C1}}}{R50}\right) + \left(\frac{3V_{BE2}}{R51}\right)\right]$$

As shown in FIG. 5*b*, the bandgap reference circuit 510 is similar to the circuit 500 in FIG. 5*a* except that, in circuit 510, the generated bandgap voltage $V_{BG}$ exceeds the voltage between the base terminal and the emitter of the BJT Q52. Thus, the currents $I_2$ through the resistor R51*a* and R51*b* are positive temperature coefficient currents. The resistor R52 combines the positive temperature coefficient current $I_1$ with the three positive temperature coefficient currents $I_2$ to a current $I_{REF}$, and converts to a bandgap voltage $V_{BG}$ unaffected by temperature and manufacturing variations.

$$V_{BG} = \left[\left(\frac{V_T \ln \frac{I_1}{I_{C1}}}{R50}\right) - 3 \times \left(\frac{V_{BG} - V_{BE2}}{R51}\right)\right] \times R52$$

$$\therefore V_{BG} = \left(\frac{R51 \times R52}{R51 + 3R52}\right)\left[\left(\frac{V_T \ln \frac{I_1}{I_{C1}}}{R50}\right) + \left(\frac{3V_{BE2}}{R51}\right)\right]$$

Figure 6A:
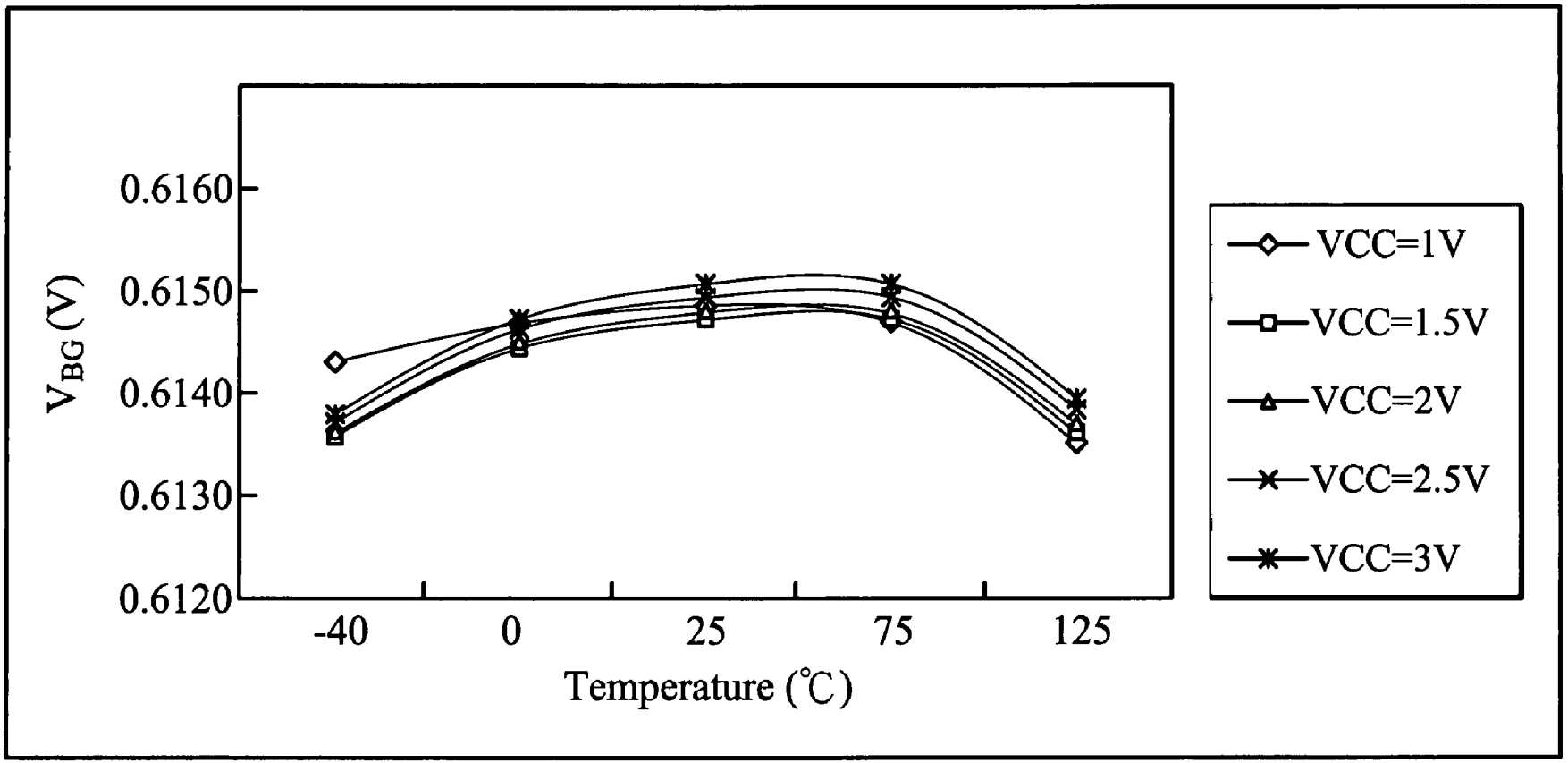
FIG. 6*a* shows simulated output of the bandgap reference circuit shown in FIG. 3*a* under different operating voltages.
Figure 6B:
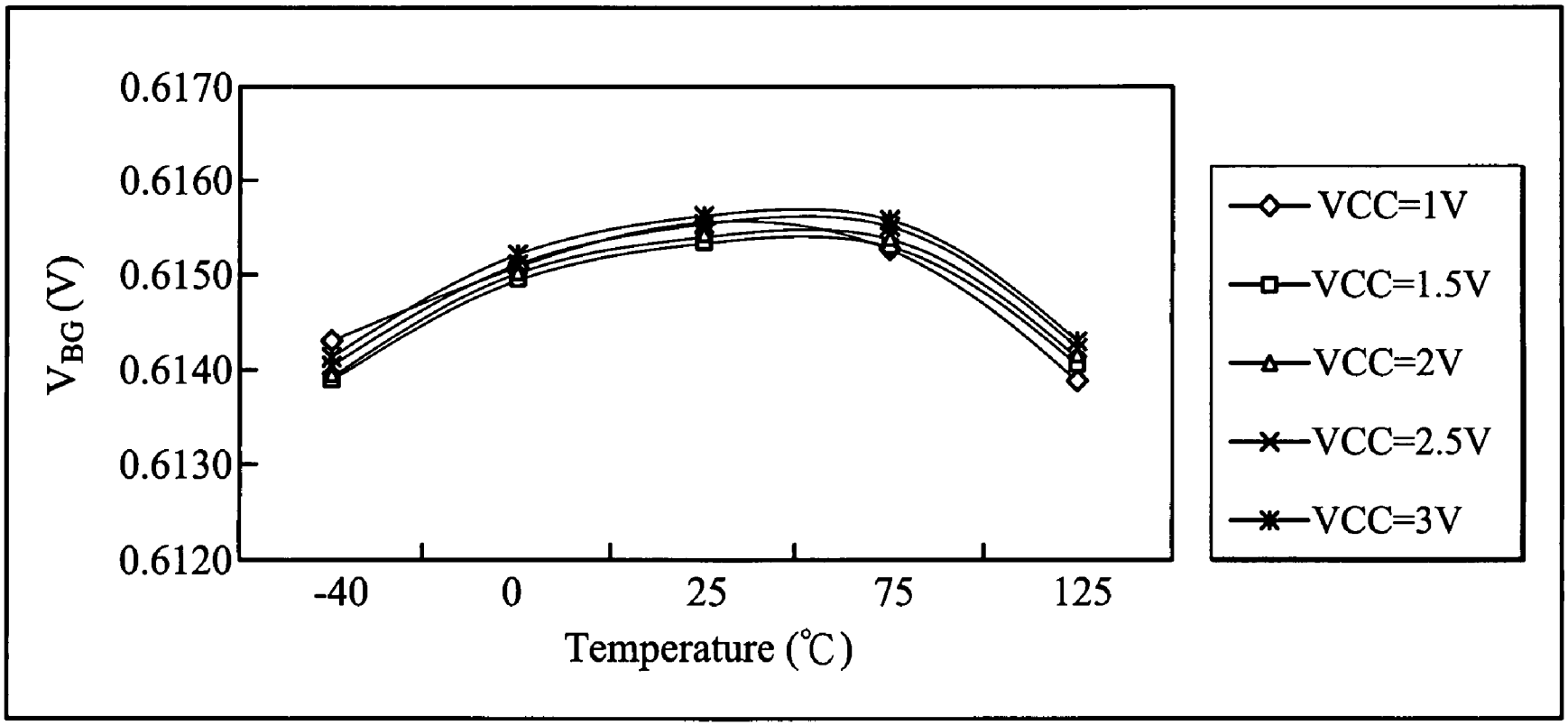
FIG. 6*b* shows simulated output of the bandgap reference circuit shown in FIG. 5*a* under different operating voltages.

FIG. 6*a* shows simulated output of the bandgap reference circuit shown in FIG. 3*a* under different operating voltages. FIG. 6*b* shows simulated output of the bandgap reference circuit shown in FIG. 5*a* under different operating voltages. As shown in FIGS. 6*a* and 6*b*, the bandgap voltages generated by the bandgap reference circuits 310 and 510 do not vary demonstrably with temperature and manufacturing variations under different voltage operations.

While the invention has been described by way of example and in terms of preferred embodiment, it is to be understood that the disclose is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bandgap reference circuit, comprising:

a current generator comprising a first bipolar junction transistor (BJT), generating a first positive temperature coefficient current, thereby producing a negative temperature coefficient voltage between a base terminal and an emitter terminal of the first bipolar junction transistor;

a single-end gain amplifier comprising a positive input terminal coupled to the emitter terminal of first the bipolar junction transistor and an output terminal;

a first resistor coupled between the output terminal of the single-end gain amplifier and an output terminal of the bandgap reference circuit to generate a first current; and a current-to-voltage converter coupled to the first resistor, converting the first positive temperature coefficient current and the first current to a bandgap voltage.

2. The bandgap reference circuit as claimed in claim 1, wherein the current generator further comprises:

an amplifier comprising a negative input terminal coupled to the emitter terminal of the first bipolar junction transistor;

a plurality of PMOS transistors, wherein gate terminals of which are coupled to an output terminal of the amplifier, source terminals of which are coupled to an operating voltage, a first drain terminal of which outputs the positive temperature coefficient current to the current-to-voltage converter, and a second drain terminal of which is coupled to the emitter terminal of the first bipolar junction transistor and the negative input terminal of the amplifier;

a second resistor comprising a first terminal coupled to an positive input terminal of the amplifier and a third drain terminal of the PMOS transistors and a second terminal; and a plurality of second bipolar junction transistors, connected in parallel, and each having an emitter terminal coupled to the second terminal of the second resistor, a base terminal and a collector terminal both coupled to a ground voltage.

3. The bandgap reference circuit as claimed in claim 1, wherein the first current is a negative temperature coefficient current, and the current-to-voltage converter combines the first positive temperature coefficient current with the negative temperature coefficient current to a second current and converts the second current to the bandgap voltage.

4. The bandgap reference circuit as claimed in claim 3, wherein the bandgap voltage is less than the negative temperature coefficient voltage between the base terminal and the emitter terminal of the first bipolar junction transistor.

5. The bandgap reference circuit as claimed in claim 1, wherein the first current is a second positive temperature coefficient current, the current-to-voltage converter combines the first positive temperature coefficient current with the second positive temperature coefficient current to a second current and converts the second current to the bandgap voltage.

6. The bandgap reference circuit as claimed in claim 5, wherein the bandgap voltage exceeds the negative temperature coefficient voltage between the base terminal and the emitter terminal of the first bipolar junction transistor.

7. The bandgap reference circuit as claimed in claim 1, wherein the current-to-voltage converter is a resistor with one grounded end.

8. The bandgap reference circuit as claimed in claim 1, wherein the base terminal of the first bipolar junction transistor and a Collector terminal thereof are coupled to the ground voltage.

9. A bandgap reference circuit, comprising:

a current generator comprising first bipolar junction transistors (BJTs) connected in parallel, generating a first positive temperature coefficient current thereby producing a negative temperature coefficient voltage between base terminals and emitter terminals of the first bipolar junction transistors;

a single-end gain amplifier comprising a positive input terminal coupled to the emitter terminals of the first bipolar junction transistors and an output terminal;

a first resistor coupled between the output terminal of the single-end gain amplifier and an output terminal of the bandgap reference circuit, generating a first current; and a current-to-voltage converter coupled to the first resistor, converting the first positive temperature coefficient current and the first current to a bandgap voltage.

10. The bandgap reference circuit as claimed in claim 9, wherein the current generator further comprises:

an amplifier comprising a negative input terminal, a positive input terminal and an output terminal;

a second bipolar junction transistor comprising an emitter terminal coupled to the negative input terminal of the amplifier and a base terminal and a Collector terminal coupled to a ground voltage;

a plurality of PMOS transistors, wherein gate terminals of which are coupled to the output terminal of the amplifier, source terminals of which are coupled to an operating voltage, a first drain terminal of which outputs the positive temperature coefficient current to the current-to-voltage converter, and a second drain terminal of which is coupled to the emitter terminal of the second bipolar junction transistor and the negative input terminal of the amplifier; and a second resistor comprising a first terminal coupled to the positive input terminal of the amplifier and a third drain terminal of the PMOS transistors and a second terminal coupled to emitter terminals of the first bipolar junction transistors.

11. The bandgap reference circuit as claimed in claim 9, wherein the first current is a negative temperature coefficient current, and the current-to-voltage converter combines the first positive temperature coefficient current with the negative temperature coefficient current to a second current and converts the second current to the bandgap voltage.

12. The bandgap reference circuit as claimed in claim 11, wherein the bandgap voltage is less than the negative temperature coefficient voltage.

13. The bandgap reference circuit as claimed in claim 9, wherein the first positive current is a second positive temperature coefficient current, the current-to-voltage converter combines the first temperature coefficient current with the second positive temperature coefficient current to a second current and converts the second current to the bandgap voltage.

14. The bandgap reference circuit as claimed in claim 13, wherein the bandgap voltage exceeds the negative temperature coefficient voltage.

15. The bandgap reference circuit as claimed in claim 9, wherein the current-to-voltage converter is a resistor with one grounded end.

16. The bandgap reference circuit as claimed in claim 9, wherein the base terminal of the first bipolar junction transistor and a Collector terminal thereof are coupled to the ground voltage.

17. A bandgap reference circuit, comprising:

a current generator comprising a first bipolar junction transistor (BJT), generating a first positive temperature coefficient current and a plurality of second bipolar junction transistors connected in parallel to generate a second positive temperature coefficient current;

a first resistor coupled between an emitter terminal of the first bipolar junction transistor and an output terminal of the bandgap reference circuit to generate a first current;

a second resistor coupled between the output terminal of the bandgap reference circuit and emitter terminals of the second bipolar junction transistors to generate a second current; and a current-to-voltage converter coupled to the first and second resistors, converting the first and second positive temperature coefficient currents and the first and second currents to a bandgap voltage.

18. The bandgap reference circuit as claimed in claim 17, wherein the current generator further comprises:

an amplifier comprising a negative input terminal coupled to the emitter terminal of the first bipolar junction transistor;

a plurality of PMOS transistors, wherein gates terminal of which are coupled to an output terminal of the amplifier, source terminals of which are coupled to an operating voltage, a first drain terminal of which outputs the positive temperature coefficient current to the current-to-voltage converter, and a second drain terminal of which is coupled to the emitter terminal of the first bipolar junction transistor and the negative input terminal of the amplifier; and a third resistor comprising a first terminal coupled to an positive input terminal of the amplifier and a third drain terminal of the PMOS transistors and a second terminal coupled to the plurality of second bipolar junction transistors.

19. The bandgap reference circuit as claimed in claim 17, wherein the first current is a first negative temperature coefficient current and the second current is a second negative temperature coefficient current, the current-to-voltage converter combines the first and second positive temperature coefficient currents with the first and second negative temperature coefficient currents to a third current and converts the third current to the bandgap voltage.

20. The bandgap reference circuit as claimed in claim 19, wherein the bandgap voltage is less than the negative temperature coefficient voltage.

21. The bandgap reference circuit as claimed in claim 17, wherein the first current is a third positive temperature coefficient current and the second current is a fourth positive temperature coefficient current, the current-to-voltage converter combines the first to fourth positive temperature coefficient currents to a third current and converts the third current to the bandgap voltage.

22. The bandgap reference circuit as claimed in claim 21, wherein the bandgap voltage exceeds the negative temperature coefficient voltage.

23. The bandgap reference circuit as claimed in claim 17, wherein the current-to-voltage converter is a resistor with one grounded end.

24. The bandgap reference circuit as claimed in claim 17, wherein the base terminal of the first bipolar junction transistor and a Collector terminal thereof, and the base terminals of the second bipolar junction transistors and Collector terminals thereof are coupled to the ground voltage.

25. The bandgap reference circuit as claimed in claim 19, further comprising:

a first single-end gain amplifier coupled between the first resistor and the first bipolar junction transistor, and comprising a positive input terminal coupled to the emitter terminal of the first bipolar junction transistor and an output terminal coupled to the first resistor; and a second single-end gain amplifier coupled between the second resistor and the second bipolar junction transistors, and comprising a positive input terminal coupled to the emitter terminals of the second bipolar junction transistors and an output terminal coupled to the second resistor.

* * * * *